US008653928B2

(12) United States Patent
Nogi et al.

(10) Patent No.: US 8,653,928 B2
(45) Date of Patent: Feb. 18, 2014

(54) COMMON MODE NOISE FILTER

(75) Inventors: Kenichiro Nogi, Takasaki (JP); Koji Taketomi, Takasaki (JP); Yoshiyuki Motomiya, Takasaki (JP); Takumi Takahashi, Takasaki (JP); Hidemi Iwao, Takasaki (JP); Masayuki Shimizu, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/824,890

(22) PCT Filed: Sep. 9, 2011

(86) PCT No.: PCT/JP2011/070554

§ 371 (c)(1),
(2), (4) Date: May 3, 2013

(87) PCT Pub. No.: WO2012/039296

PCT Pub. Date: Mar. 29, 2012

(65) Prior Publication Data

US 2013/0229252 A1 Sep. 5, 2013

(30) Foreign Application Priority Data

Sep. 22, 2010 (JP) ..... 2010-211957

(51) Int. Cl.
*H01F 5/00* (2006.01)
*H01F 27/24* (2006.01)

(52) U.S. Cl.
USPC ..... 336/200; 336/232

(58) Field of Classification Search
USPC ..... 336/200, 232
See application file for complete search history.

(56) References Cited

U.S. PATENT DOCUMENTS

| | | | | |
|---|---|---|---|---|
| 7,091,816 | B1 | 8/2006 | Ito et al. | |
| 2002/0093415 | A1 * | 7/2002 | Kitamura | 336/200 |
| 2004/0263309 | A1 | 12/2004 | Ito et al. | |
| 2006/0158301 | A1 * | 7/2006 | Shinkai et al. | 336/232 |
| 2006/0176138 | A1 | 8/2006 | Ito et al. | |
| 2010/0052838 | A1 * | 3/2010 | Matsuta et al. | 336/200 |

FOREIGN PATENT DOCUMENTS

| | | | |
|---|---|---|---|
| JP | H06-045307 | U | 6/1994 |
| JP | 2004-260017 | A1 | 9/2004 |
| JP | 2005-340611 | A1 | 12/2005 |
| JP | 2006-261585 | A1 | 9/2006 |
| JP | 2006-351962 | A1 | 12/2006 |

* cited by examiner

*Primary Examiner* — Tsz Chan
(74) *Attorney, Agent, or Firm* — Law Office of Katsuhiro Arai

(57) ABSTRACT

A common mode noise filter includes: a first magnetic body and a second magnetic body; a non-magnetic body sandwiched between the first magnetic body and second magnetic body; and a first coil conductor and a second coil conductor of planar shape which are embedded in the non-magnetic body and positioned on the first magnetic body side and second magnetic body side in the non-magnetic body in a manner facing each other in a non-contact state; wherein a first lead conductor that connects one end of the first coil conductor to a first external terminal is embedded in the non-magnetic body 13, while a second lead conductor that connects one end of the second coil conductor to a third external terminal is embedded in the non-magnetic body.

3 Claims, 2 Drawing Sheets

COMMON MODE NOISE FILTER

This application is the U.S. National Phase under 35 U.S.C. §371 of International Application PCT/JP2011/070554, which claims priority to Japanese Patent Application No. 2010-211957, filed Sep. 22, 2010. The International Application was published under PCT Article 21(2) in a language other than English.

TECHNICAL FIELD

The present invention relates to a common mode noise filter used as a noise elimination device in various electronic equipment.

BACKGROUND ART

Patent Literature 1 discloses a common mode noise filter comprising: a first magnetic body and a second magnetic body; a non-magnetic body sandwiched between the first magnetic body and second magnetic body; a first coil conductor and a second coil conductor of planar shape which are embedded in the non-magnetic body and positioned on the first magnetic body side and second magnetic body side in the non-magnetic body in a manner facing each other in a non-contact state; a first external terminal connected to one end of the first coil conductor via a first lead conductor; a second external terminal connected to the other end of the first coil conductor; a third external terminal connected to one end of the second coil conductor via a second lead conductor; and a fourth external terminal connected to the other end of the second coil conductor.

With this common mode noise filter, the first lead conductor is present between the first magnetic body and non-magnetic body, and the second lead conductor is present between the second magnetic body and non-magnetic body. Additionally, $Fe_2O_3$-based ferrite is used for the first magnetic body and second magnetic body, Cu—Zn ferrite or glass ceramics is used for the non-magnetic body, and silver is used for the first lead conductor, first coil conductor, second coil conductor, and second lead conductor.

In the above, this common mode noise filter is generally mounted on a circuit board, etc., by means of reflow soldering and thus receives considerable thermal shock when reflow-soldered, and once mounted the filter also receives thermal shock when exposed to high temperature or low temperature.

Since this common mode noise filter is structured in such a way that the first lead conductor lies between the first magnetic body and non-magnetic body and the second lead conductor lies between the second magnetic body and non-magnetic body, separation occurs at the following locations when the aforementioned thermal shock is received, due to differences between the coefficient of linear expansion of the first lead conductor and coefficients of linear expansion of the first magnetic body and non-magnetic body and also between the coefficient of linear expansion of the second lead conductor and coefficients of linear expansion of the second magnetic body and non-magnetic body:

interface between the first lead conductor and first magnetic body, interface between the first lead conductor and non-magnetic body, interface between the second lead conductor and second magnetic body, and interface between the second lead conductor and non-magnetic body.

Because of this separation, delamination occurs at the following locations to cause filter characteristics such as the impedance characteristics or the like to deteriorate:

interface between the first magnetic body and non-magnetic body, and interface between the second magnetic body and non-magnetic body.

BACKGROUND ART LITERATURE

Patent Literature

Patent Literature 1: Japanese Patent Laid-open No. 2005-340611

SUMMARY OF THE INVENTION

Problems to Be Solved by the Invention

The object of the present invention is to provide a common mode noise filter that can suppress deterioration of its filter characteristics caused by delamination resulting from thermal shock received at the time of reflow soldering, etc.

Means for Solving the Problems

To achieve the aforementioned object, the present invention provides a common mode noise filter comprising: a first magnetic body and a second magnetic body; a non-magnetic body sandwiched between the first magnetic body and second magnetic body; a first coil conductor and a second coil conductor of planar shape which are embedded in the non-magnetic body and positioned on the first magnetic body side and second magnetic body side in the non-magnetic body in a manner facing each other in a non-contact state; a first external terminal connected to one end of the first coil conductor via a first lead conductor; a second external terminal connected to the other end of the first coil conductor; a third external terminal connected to one end of the second coil conductor via a second lead conductor; and a fourth external terminal connected to the other end of the second coil conductor; wherein such common mode noise filter is characterized in that the first lead conductor is embedded in the non-magnetic body except where connected to the first external terminal, while the second lead conductor is embedded in the non-magnetic body except where connected to the third external terminal.

If the first lead conductor lies between the first magnetic body and non-magnetic body and the second lead conductor lies between the second magnetic body and non-magnetic body, as is the case with the conventional common mode noise filter described in [Prior Art] above, separation occurs at the following locations when thermal shock is received at the time of reflow soldering, etc., due to differences between the coefficient of linear expansion of the first lead conductor and coefficients of linear expansion of the first magnetic body and non-magnetic body and also between the coefficient of linear expansion of the second lead conductor and coefficients of linear expansion of the second magnetic body and non-magnetic body:

interface between the first lead conductor and first magnetic body, interface between the first lead conductor and non-magnetic body, interface between the second lead conductor and second magnetic body, and interface between the second lead conductor and non-magnetic body.

Because of this separation, delamination occurs at the following locations to cause filter characteristics such as the impedance characteristics or the like to deteriorate:

interface between the first magnetic body and non-magnetic body, and interface between the second magnetic body and non-magnetic body.

On the other hand, the common mode noise filter proposed by the present invention is structured in such a way that the first lead conductor is embedded in the non-magnetic body except where connected to the first external terminal, while the second lead conductor is embedded in the non-magnetic body except where connected to the third external terminal, or in other words, there is no interface where three materials, each of a different coefficient of linear expansion, are present. Accordingly, separation does not occur at the following locations when the aforementioned thermal shock is received:

interface between the first magnetic body and non-magnetic body, and interface between the second magnetic body and non-magnetic body.

In essence, delamination does not occur easily at the following locations even when the aforementioned thermal shock is received, because of the above structure and also because the coefficient of linear expansion of each magnetic body can be brought closer to the coefficient of linear expansion of the non-magnetic body:

interface between the first magnetic body and non-magnetic body, and interface between the second magnetic body and non-magnetic body.

Accordingly, deterioration of filter characteristics such as impedance characteristics or the like caused by delamination can be suppressed in a reliable manner.

Effects of the Invention

According to the present invention, a common mode noise filter is provided which can suppress deterioration of its filter characteristics caused by delamination resulting from thermal shock received at the time of reflow soldering, etc.

The aforementioned object and other objects, constitution and characteristics, and operation and effects, of the present invention are made clear by the following explanation and attached drawings.

BRIEF DESCRIPTION OF THE DRAWINGS

FIG. 2 (S12) is a section view of FIG. 1 cut along line S12; and FIG. 2 (S13) is a section view of FIG. 1 cut along line S13.

MODE FOR CARRYING OUT THE INVENTION

Figure 1:
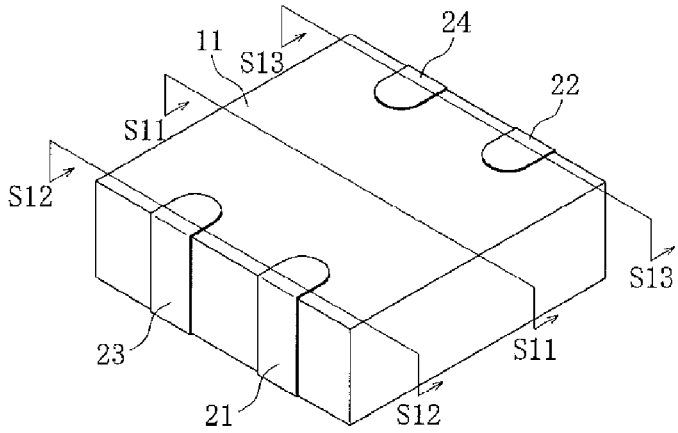
FIG. 1 is a drawing showing an exterior perspective view of a common mode noise filter to which the present invention is applied (an embodiment).

A common mode noise filter to which the present invention is applied (an embodiment) is explained below using FIGS. 1 to 3. As shown in FIG. 1, this common mode noise filter comprises a filter body 11 of rectangular solid shape and first through fourth external terminals 21 to 24 provided on the opposing two side faces of the filter body 11.

Figure 3:
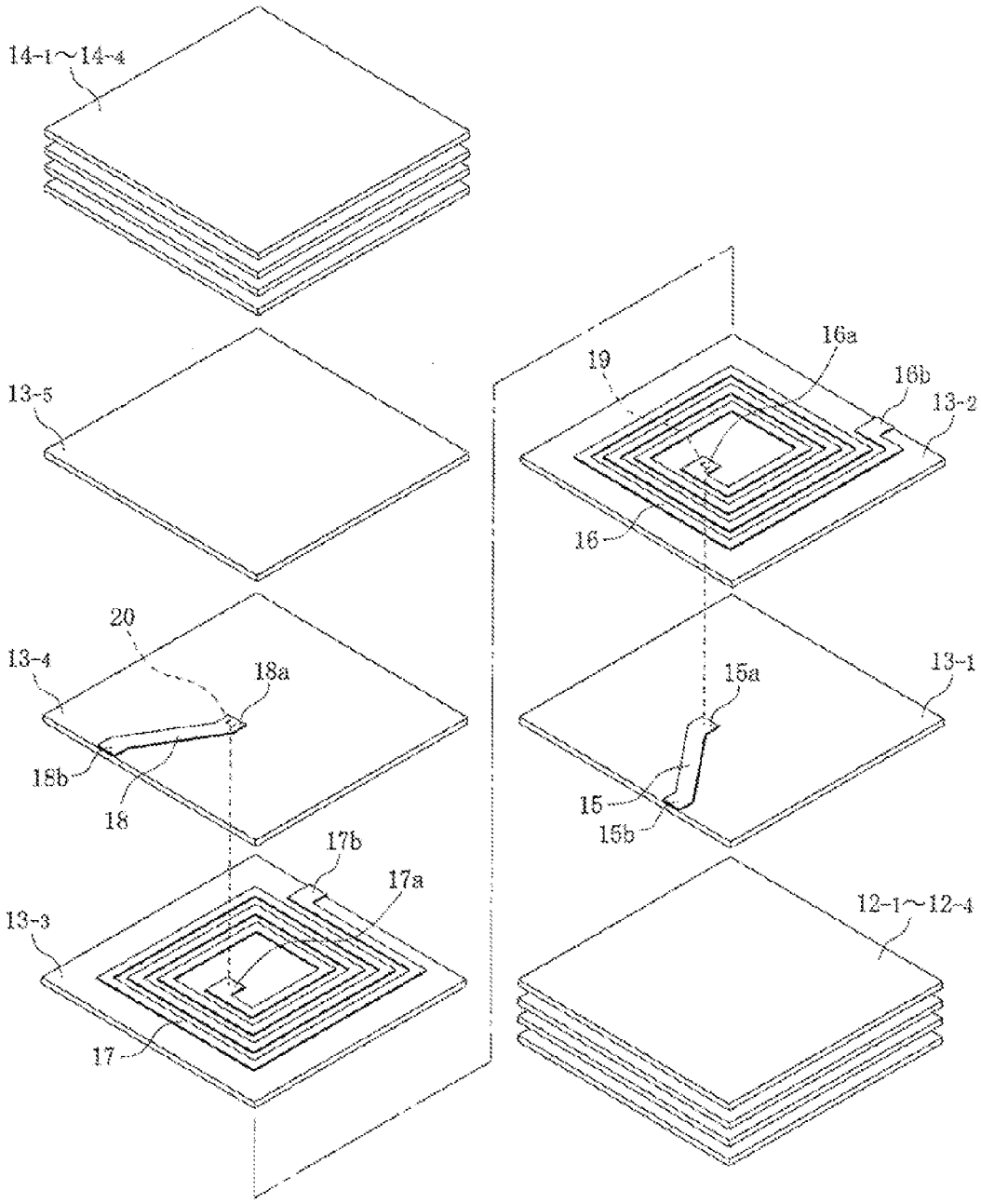
FIG. 3 is a drawing showing an exploded perspective view of each layer of the filter shown in FIG. 1.

As shown in FIG. 3 providing an exploded view of each layer of the filter body 11, the filter body 11 has the following:

four magnetic layers 12-1 to 12-4, five first through fifth non-magnetic layers 13-1 to 13-5, four magnetic layers 14-1 to 14-4, first lead conductor 15 positioned between the first non-magnetic layer 13-1 and second non-magnetic layer 13-2, first coil conductor 16 of planar shape positioned between the second non-magnetic layer 13-2 and third non-magnetic layer 13-3, second coil conductor 17 of planar shape positioned between the third non-magnetic layer 13-3 and fourth non-magnetic layer 13-4, second lead conductor 18 positioned between the fourth non-magnetic layer 13-4 and fifth non-magnetic layer 13-5, first via conductor 19 provided in the second non-magnetic layer 13-2, and second via conductor 20 provided in the fourth non-magnetic layer 13-4.

The magnetic layers 12-1 to 12-4, 14-1 to 14-4 are made of any known magnetic material, preferably Ni—Zn—Cn ferrite or other ferrite material. The first through fifth non-magnetic layers 13-1 to 13-5 are made of any known non-magnetic material, preferably borosilicate glass or other dielectric material. The first lead conductor 15, first coil conductor 16, second coil conductor 17, second lead conductor 18, first via conductor 19, and second via conductor 20 are made of any known conductor material, preferably silver or other metal material.

Figure 2:
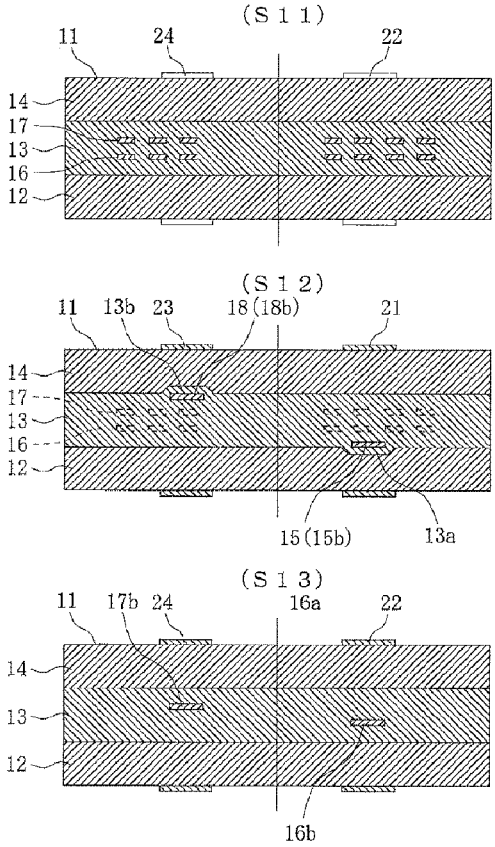
FIG. 2 is a drawing explaining a section view of FIG. 1 cut along line S11.

The four magnetic layers 12-1 to 12-4 shown in FIG. 3 constitute the first magnetic body 12 shown in FIG. 2, the five first through fifth non-magnetic layers 13-1 to 13-5 constitute the non-magnetic body 13 shown in FIG. 2, the four magnetic layers 14-1 to 14-4 constitute the second magnetic body 14 shown in FIG. 2, and the non-magnetic body 13 is sandwiched between the first magnetic body 12 and second magnetic body 14 in a manner contacting the two magnetic bodies 12, 14.

The first coil conductor 16 and second coil conductor 17 form spirals of roughly the same wire width and number of windings. One end 16*a* of the first coil conductor 16 is connected to one end 15*a* of the first lead conductor 15 via the first via conductor 19, while the side edge at the other end 15*b* of the first lead conductor 15 and side edge at the other end 16*b* of the first coil conductor 16 are exposed on the opposing side faces of the non-magnetic body 13. One end 17*a* of the second coil conductor 17 is connected to one end 18*a* of the second lead conductor 18 via the second via conductor 20, while the side edge at the other end 18*b* of the second lead conductor 18 and side edge at the other end 17*b* of the second coil conductor 17 are exposed on the opposing side faces of the non-magnetic body 13.

The first through fourth external terminals 21 to 24 are made of any known conductor material, preferably silver or other metal material. As shown in FIG. 1, the first external terminal 21 and third external terminal 23 are provided on one side face of the filter body 11 with some distance between them, while the second external terminal 22 and fourth external terminal 24 are provided on the opposite side face of the filter body 11 with some distance between them.

To be specific, the first external terminal 21 is connected to the side edge at the other end 15*b* of the first lead conductor 15 exposed on one side face of the non-magnetic body 13, while the second external terminal 22 is connected to the side edge at the other end 16*b* of the first coil conductor 16 exposed on the opposite side face of the non-magnetic body 13. The third external terminal 23 is connected to the side edge at the other end 18*b* of the second lead conductor 18 exposed on one side face of the non-magnetic body 13, while the fourth external terminal 24 is connected to the side edge at the other end 17*b* of the second coil conductor 17 exposed on the opposite side face of the non-magnetic body 13.

Here, how the aforementioned common mode noise filter is manufactured is explained briefly.

To manufacture the common mode noise filter, the following are prepared:

unsintered magnetic layers 12-1 to 12-4, 14-1 to 14-4, unsintered first non-magnetic layer 13-1 on which an unsintered first lead conductor 15 is formed, unsintered second non-magnetic layer 13-2 on which an unsintered first coil conductor 16 and first via conductor 19 are formed, unsintered third non-magnetic layer 13-3 on which an unsintered second coil conductor 17 is formed, unsintered fourth non-magnetic layer 13-4 on which an unsintered second lead conductor 18 and second via conductor 20 are formed, and unsintered fifth non-magnetic layer 13-5.

These layers are then layered in the order shown in FIG. 3 and the entire laminate is thermally pressure-bonded, after which the thermally pressure-bonded laminate is sintered (and also binder-removed) at a specified temperature to produce a filter body 11. Thereafter, unsintered first through fourth external terminals 21 to 24 are formed on the two opposing side faces of the filter body 11, and then sintered (and also binder-removed) at the specified temperature. If necessary, nickel layers are formed by the electroplating method on the surfaces of the first through fourth external terminals 21 to 24, and solder layers are formed on top using the electroplating method.

As explained earlier, the first lead conductor 15 is present between the first non-magnetic layer 13-1 and second non-magnetic layer 13-2, the first coil conductor 16 is present between the second non-magnetic layer 13-2 and third non-magnetic layer 13-3, the second coil conductor 17 is present between the third non-magnetic layer 13-3 and fourth non-magnetic layer 13-4, and the second lead conductor 18 is present between the fourth non-magnetic layer 13-4 and fifth non-magnetic layer 13-5.

As a result, the first coil conductor 16 is positioned in the non-magnetic body 13 on the first magnetic body 12 side, while the second coil conductor 17 is positioned in the non-magnetic body 13 on the second magnetic body 14 side, where the first coil conductor 16 and second coil conductor 17 are embedded in the non-magnetic body 13 in a manner facing each other in a non-contact state (refer to FIG. 2 (S11)).

Also, the first lead conductor 15 is embedded in the non-magnetic body 13 except for the side edge at the other end 15*b* (where the conductor is connected to the first external terminal 21), while the second lead conductor 18 is embedded in the non-magnetic body 13 except for the side edge at the other end 18*b* (where the conductor is connected to the third external terminal 23) (refer to FIG. 2 (S12)).

Furthermore, because the entire laminate is thermally pressure-bonded in the manufacturing process, a part 13*a* of the non-magnetic body 13 covering the first lead conductor 15 present at a position closer to the first magnetic body 12 than the first coil conductor 16 protrudes toward the first magnetic body 12 and bites into the first magnetic body 12, while a part 13*b* of the non-magnetic body 13 covering the second lead conductor 18 present at a position closer to the second magnetic body 14 than the second coil conductor 17 protrudes toward the second magnetic body 14 and bites into the second magnetic body 14 (refer to FIG. 2 (S12)).

In the meantime, the aforementioned common mode noise filter is generally mounted on a circuit board, etc., by means of reflow soldering and thus receives considerable thermal shock when reflow-soldered, and once mounted the filter also receives thermal shock when exposed to high temperature or low temperature.

If the first lead conductor lies between the first magnetic body and non-magnetic body and the second lead conductor lies between the second magnetic body and non-magnetic body, as is the case with the conventional common mode noise filter described in [Prior Art] above, separation occurs at the following locations when the aforementioned thermal shock is received, due to differences between the coefficient of linear expansion of the first lead conductor and coefficients of linear expansion of the first magnetic body and non-magnetic body and also between the coefficient of linear expansion of the second lead conductor and coefficients of linear expansion of the second magnetic body and non-magnetic body:

interface between the first lead conductor and first magnetic body, interface between the first lead conductor and non-magnetic body, interface between the second lead conductor and second magnetic body, and interface between the second lead conductor and non-magnetic body.

Because of this separation, delamination occurs at the following locations to cause filter characteristics such as the impedance characteristics or the like to deteriorate:

interface between the first magnetic body and non-magnetic body, and interface between the second magnetic body and non-magnetic body.

On the other hand, the aforementioned common mode noise filter is structured in such a way that the first lead conductor 15 is embedded in the non-magnetic body 13 except where connected to the first external terminal 21 and the second lead conductor 18 is embedded in the non-magnetic body 13 except where connected to the third external terminal 23, or in other words, there is no interface where three materials, each of a different coefficient of linear expansion, are present. Accordingly, separation does not occur at the following locations when the aforementioned thermal shock is received:

interface between the first magnetic body 12 and non-magnetic body 13, and interface between the second magnetic body 14 and non-magnetic body 13.

In essence, delamination does not occur easily at the following locations even when the aforementioned thermal shock is received, because of the above structure and also because the coefficient of linear expansion of each magnetic body 12, 14 can be brought closer to the coefficient of linear expansion of the non-magnetic body 13:

interface between the first magnetic body 12 and non-magnetic body 13, and interface between the second magnetic body 14 and non-magnetic body 13.

Accordingly, deterioration of filter characteristics such as impedance characteristics or the like caused by delamination can be suppressed in a reliable manner.

Additionally with the aforementioned common mode noise filter, a part 13*a* of the non-magnetic body 13 covering the first lead conductor 15 present at a position closer to the first magnetic body 12 than the first coil conductor 16 protrudes toward the first magnetic body 12 and bites into the first magnetic body 12, while a part 13*b* of the non-magnetic body 13 covering the second lead conductor 18 present at a position closer to the second magnetic body 14 than the second coil conductor 17 protrudes toward the second magnetic body 14 and bites into the second magnetic body 14. In essence, the contact force between the first magnetic body 12 and non-magnetic body 13 is higher than when two planes are contacting each other, while the contact force between the second magnetic body 14 and non-magnetic body 13 is higher than when two planes are contacting each other, and therefore even when stress that causes delamination acts upon the following locations, generation of delamination can be effectively prevented based on the aforementioned contact forces and thus deterioration of filter characteristics can be suppressed in a more reliable manner.

interface between the first magnetic body 12 and non-magnetic body 13, and interface between the second magnetic body 14 and non-magnetic body 13.

Although the foregoing explanation indicates a structure whereby four magnetic layers 12-1 to 12-4 constitute the first magnetic body 12 and four magnetic layers 14-1 to 14-4 constitute the second magnetic body 14, the same effects mentioned above can still be achieved even when the number of magnetic layers constituting each magnetic body 12, 14 is increased/decreased in a desired manner according to the thickness of the magnetic layer, thickness of each magnetic body 12, 14, etc.

Additionally, although the foregoing explanation gives an example where one first non-magnetic layer 13-1 lies between the four magnetic layers 12-1 to 12-4 and first lead conductor 15, while one fifth non-magnetic layer 13-5 lies between the second lead conductor 18 and four magnetic layers 14-1 to 14-4, the same effects mentioned above can still be achieved even when two or more first non-magnetic layers 13-1 lie between the four magnetic layers 12-1 to 12-4 and first lead conductor 15, or two or more fifth non-magnetic layers 13-5 lie between the second lead conductor 18 and four magnetic layers 14-1 to 14-4.

Moreover, although the foregoing explanation indicates that the first coil conductor 16 and second coil conductor 17 are straight conductor wires of the specified width being spiraled around corners of roughly right angles, the same effects mentioned above can still be achieved even when straight conductor wires of the specified width are spiraled around curved corners, or conductor wires of the specified wire width are entirely curved in a spiraling manner.

Furthermore, although the foregoing explanation indicates that the common mode noise filter has one pair of coil conductors 16, 17 as well as two pairs of external terminals 21 to 24 corresponding to the one pair of coil conductors 16, 17, the same effects mentioned above can still be achieved even when a common mode noise filter of double coil pairs is constituted where the filter body is formed long sideways and two pairs of coil conductors are embedded side by side and then four pairs of external terminals corresponding to the two pairs of coil conductors are provided, or when a common mode noise filter of three or more coil pairs is constituted.

DESCRIPTION OF THE SYMBOLS

11 Filter body
12 First magnetic body
13 Non-magnetic body
13*a* Part of the non-magnetic body protruding toward the first magnetic body
13*b* Part of the non-magnetic body protruding toward the second magnetic body
14 Second magnetic body
15 First lead conductor
16 First coil conductor
17 Second coil conductor
18 Second lead conductor
19 First via conductor
20 Second via conductor
21 First external terminal
22 Second external terminal
23 Third external terminal
24 Fourth external terminal.

What is claimed is:

1. A common mode noise filter comprising: a first magnetic body and a second magnetic body; a non-magnetic body sandwiched between the first magnetic body and second magnetic body; a first coil conductor and a second coil conductor of planar shape which are embedded in the non-magnetic body and positioned on the first magnetic body side and second magnetic body side in the non-magnetic body in a manner facing each other in a non-contact state; a first external terminal connected to one end of the first coil conductor via a first lead conductor; a second external terminal connected to other end of the first coil conductor; a third external terminal connected to one end of the second coil conductor via a second lead conductor; and a fourth external terminal connected to other end of the second coil conductor;

wherein the first lead conductor is embedded in the non-magnetic body except where connected to the first external terminal, and the second lead conductor is embedded in the non-magnetic body except where connected to the third external terminal, wherein with the first lead conductor embedded in the non-magnetic body, a part of the non-magnetic body covering the first lead conductor present at a position closer to the first magnetic body than the first coil conductor protrudes toward the first magnetic body and bites into the first magnetic body; and with the second lead conductor embedded in the non-magnetic body, a part of the non-magnetic body covering the second lead conductor present at a position closer to the second magnetic body than the second coil conductor protrudes toward the second magnetic body and bites into the second magnetic body.

2. A common mode noise filter according to claim 1, wherein one end of the first coil conductor is connected to the first lead conductor through a first via conductor provided in the non-magnetic body; and one end of the second coil conductor is connected to the second lead conductor through a second via conductor provided in the non-magnetic body.

3. A common mode noise filter according to claim 1, wherein the non-magnetic body, the first magnetic body, and the second magnetic body are constituted by layers, respectively, which layers are sintered simultaneously.

* * * * *